US006439942B1

(12) United States Patent
Pillai et al.

(10) Patent No.: US 6,439,942 B1
(45) Date of Patent: Aug. 27, 2002

(54) HEATED LINER FOR WEARING UNDER AN UPPER TORSO GARMENT

(76) Inventors: Meghan Kathleen Pillai, 8280 Peconic Bay Blvd., Laurel, NY (US) 11948; Bala H. Pillai, 912 Roanoke Ave., Riverhead, NY (US) 11948

( * ) Notice: Subject to any disclaimer, the term of this patent is extended or adjusted under 35 U.S.C. 154(b) by 0 days.

(21) Appl. No.: 09/771,611

(22) Filed: Jan. 30, 2001

(51) Int. Cl.[7] ..... B63C 9/11

(52) U.S. Cl. ..... 441/106; 2/905; 218/211; 441/115

(58) Field of Search ..... 441/102–119; 219/211; 2/458, 905

(56) References Cited

U.S. PATENT DOCUMENTS 4,404,460 A * 9/1983 Kerr ..... 2/69
5,148,002 A * 9/1992 Kuo et al. ..... 219/211
5,603,648 A * 2/1997 Kea ..... 441/106
5,893,991 A * 4/1999 Newell ..... 219/211
6,005,222 A * 12/1999 Hicks ..... 2/79
6,049,062 A * 4/2000 Jones ..... 219/211

FOREIGN PATENT DOCUMENTS

FR 2 577 116 * 8/1986

* cited by examiner

*Primary Examiner*—Sherman Basinger

(57) ABSTRACT

A heated liner that is worn under an upper torso garment. The liner includes an upper torso-covering garment that underlies the upper torso garment, heating wires, storage batteries that are in electrical communication with, and power, the heating wires, solar cells that are in electrical communication with, and recharge, the storage batteries, and a thermostat that is in electrical communication with, and regulates the heat generated by, the heating wires.

6 Claims, 3 Drawing Sheets

HEATED LINER FOR WEARING UNDER AN UPPER TORSO GARMENT

BACKGROUND OF THE INVENTION

1. Field of the Invention

The present invention relates to a liner for wearing under an upper torso garment. More particularly, the present invention relates to a heated liner for wearing under an upper torso garment.

2. Description of the Prior Art:

Commercial fishing boats, recreational, and other water craft often are operated in relatively cold water. Additionally, off-shore drilling platforms are frequently located in severe cold water environments. Individuals engaged in such activities in cold water environments are subject to the potential dangers of being accidentally immersed in cold water for substantial periods of time before they are rescued.

The greatest danger other than drowning in such circumstances is from the rapid loss of body heat, or hypothermia, the result of lowered deep body temperature, which results in death.

Unconsciousness can occur when the deep body temperature falls to approximately 90° F. (32° C.) and heart failure is the usual cause of death when the body core cools to about 85° F. (30° C.) or below.

Several factors are involved in determining the amount of time that one can survive in cold water. These factors include the survival procedure used. If the individual is required to tread water, the body loses heat at a much faster rate than if the individual remained motionless. Swimming also results in an increased rate of body heat loss. Other factors involved include the weight of the person, amount of body fat, etc. On the average, however, a predicted survival time is about 2 ½ to 3 hours in water of 50° F.

Certain body regions have high rates of heat loss while a subject is holding still in cold water. These areas are the sides of the chest where is little muscle or fat, the head which is normally out of the water, and the groin region loses substantial heat due to large blood and lymph vessels near the surface of the skin.

Conventional life jackets typically have only flotation characteristics. The individual wearing such conventional jackets may assume a posture in the water that somewhat lessens heat loss. In this posture, the arms are held tightly to the sides of the chest with the legs together and knees drawn upward toward the chest. Although this posture may lessen the heat loss somewhat, it is highly inefficient and the survival time is not significantly increased.

Additionally, despite the improvements in winter weather garments over recent times, presently available such garments all have one characteristic in common; unless some heating accessory is introduced by the wearer, any warmth experienced by the wearer is generated by the wearer's own body.

For somewhat cold environments, and in fairly calm wind situations, "passive warming" may suffice. In extremely cold conditions, however, ones in which wind renders the temperature at an effective temperature much lower level than actual thermometer readings, some form of heat augmentation is desirable.

For years, lighter fluid-fueled "hand warmers" have been available as an auxiliary source of heat for persons who venture outdoors in cold conditions. Also, certain chemically actuated heating packets are available for emergency situations. Further still, battery operated socks and gloves are available.

The use of lighter fluid-fueled "hand warmers," however, pose obvious safety hazards, for they involve, quite literally, introducing a smoldering canister of flammable liquid into one's garment.

Furthermore, chemical heat packs are expensive, and last for limited durations, and battery powered, heated garments, such as socks and gloves, have very short service life between battery charges.

Thus there is a need for a heated liner for use with an upper torso garment.

Numerous innovations for survival garment have been provided in the prior art that will be described. Even though these innovations may be suitable for the specific individual purposes to which they address, however, they differ from the present invention in that they do not teach a heated liner for use with an upper torso garment.

FOR EXAMPLE, U.S. Pat. No. 4,015,300 to Hayward et al. teaches a flotation jacket that has flotation material therein to provide adequate inherent buoyancy for adults. A flap of waterproof insulative closed cell material is concealed on the inside of the body of the jacket and can be released therefrom to be converted into panels providing thermal protection in cold water to the lower trunk region of the wearer.

ANOTHER EXAMPLE, U.S. Pat. No. 4,137,586 to Evert teaches a survival suit having flotation and hypothermia protection characteristics. The suit includes an outer jacket and an inner jacket adapted to fit snugly about the torso of the wearer thereby minimizing any exchange of cold water. In the event of penetration of a small amount of water, the inner jacket is designed to entrap an insulating layer of water against the torso when immersed whereby high heat loss areas of the torso are thermally insulated. The outer jacket is provided with flotation material adequate to keep an adult afloat.

STILL ANOTHER EXAMPLE, U.S. Pat. No. 4,242,769 to Rayfield et al. teaches an anti-exposure inflatable structure for reducing loss of heat from the body of a wearer, having spaced inflatable cavities with water vapor openings between cavities and an outer covering of a breathable, water-proof material loosely covering the outer surface of the structure, the structure having sealing means at its marginal edges to prevent water from entering between the body of a wearer and the structure.

YET ANOTHER EXAMPLE, U.S. Pat. No. 4,394,124 to Cooper teaches a flotation life support device in which a buoyant ring is hinged to form an opening permitting entry of an occupant and in which an underwater bag depends from the ring and has an opening in alignment with the opening in the ring permitting easy entry to the ring and bag. The opening in the bag is closed by a slide fastener so that the occupant and the water contained in the bag are separated from the surrounding water to minimize dissipation of body heat. The ring also is provided with a seat to support the occupant and with a canopy to protect the occupant against spray and wave action for easier control of breathing.

STILL YET ANOTHER EXAMPLE, U.S. Pat. No. 5,603,648 to Kea teaches an outdoor survival garment having front and back portions and an integral connection including a pair of shoulder connectors extending across the shoulders of the wearer to define a neck opening; a connecting strap to connect the front and back portions over each side of-the wearer; a first solid flotation layer within the front and back portions to float a wearer of the garment in a body of water; an inflatable bladder within the front and back portions to supplement the solid flotation layer; the inflatable bladder being disposed within the garment and extending from the front to the back portions; compressed gas carried within the garment to selectively inflate the bladder; an outermost compartment disposed in the front portion of the jacket that houses a fiber optic lead inside of the outermost compartment, and which houses a LED underneath a fiber optic lead, to collectively provide lighting; at least one battery in a lowermost section of the back portion of the garment to supply power to the fiber optic and LED lighting; an array of solar element conductors or photovoltaic solar cells in a solar panel or fiber optic container in a top most section of the back portion of the garment in electrical connection to repower the fiber optic and LED lighting; at least one electrical heating element within a layer within a lining next removed from an inner most lining or compartment that extends from the front and the back portions of the garment and includes heating coil wires.

YET STILL ANOTHER EXAMPLE, U.S. Pat. No. 6,005,222 to Hicks teaches a cold weather garment which, through power produced by solar panels embedded in the exterior of the garment, which, in turn, operate heating elements, the heat from which are directed toward the interior of the garment, actively augments the wearer's natural heat production. Because the garment's heating facilities are powered by solar cells, all hazards from flammable fuels are eliminated, there are no expensive batteries to repeatedly replace, and, so long as sun light is available, the wearer will be warmed indefinitely.

It is apparent that numerous innovations for survival garments have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a heated liner for wearing under an upper torso garment that avoids the disadvantages of the prior art.

ANOTHER OBJECT of the present invention is to provide a heated liner for wearing under an upper torso garment that is simple and inexpensive to manufacture.

STILL ANOTHER OBJECT of the present invention is to provide a heated liner for wearing under an upper torso garment that is simple to use.

BRIEFLY STATED, YET ANOTHER OBJECT of the present invention is to provide a heated liner that is worn under an upper torso garment. The liner includes an upper torso-covering garment that underlies the upper torso garment, heating wires, storage batteries that are in electrical communication with, and power, the heating wires, solar cells that are in electrical communication with, and recharge, the storage batteries, and a thermostat that is in electrical communication with, and regulates the heat generated by, the heating wires. The heating wires form a continuous serpentine pattern throughout the upper torso-covering garment. The storage batteries include chest and back batteries that are disposed on the upper torso-covering garment. The solar cells include chest and back solar cells that extend from uppermost portions of the upper torso-covering garment, by lengths of solar cell wire that allows the solar cells to pass freely through openings in the upper torso garment and be replaceably attached thereto by hook and loop fasteners. The thermostat extends from the upper torso-covering garment, by lengths of thermostat wire that allows the thermostat to pass freely through an opening in the upper torso garment and be replaceably attached thereto by hook and loop fasteners.

The novel features which are considered characteristic of the present invention are set forth in the appended claims. The invention itself, however, both as to its construction and its method of operation, together with, additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
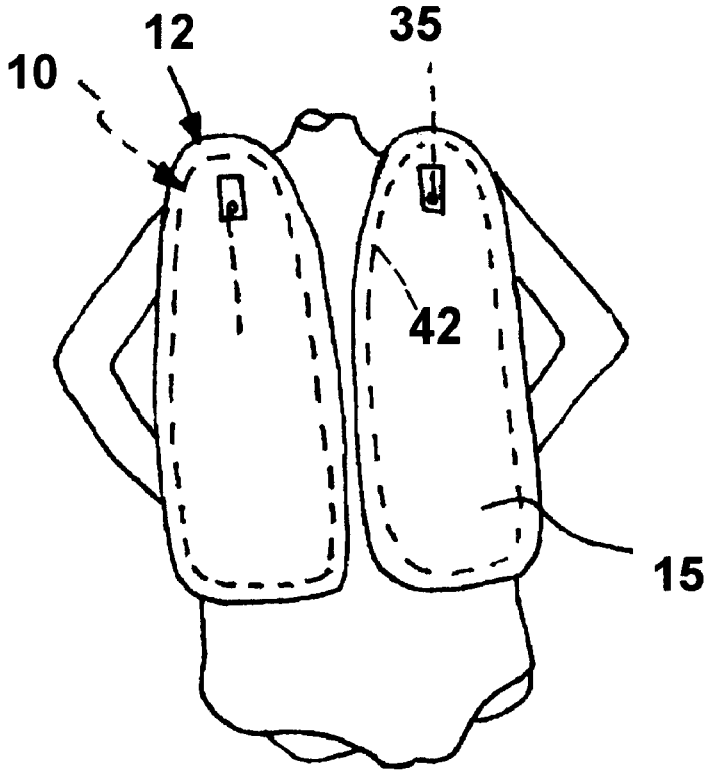
FIG. 1 is a diagrammatic front elevational view of the present invention in use.

10 heated liner of present invention for wearing under upper torso garment 12
12 upper torso garment
13 back-covering portion of upper torso garment 12
14 upper torso-covering garment for underlying upper torso garment 12
15 chest-covering portion of upper torso garment 12
16 heating wires
18 storage batteries
20 solar cells
21 thermostat for regulating heat generated by heating wires 16
22 back-covering portion of upper torso-covering garment 14 for underlying back-covering portion 13 of upper torso garment 12
24 chest-covering portion of upper torso-covering garment 14 for underlying chest-covering portion 15 of upper torso garment 12
26 chest batteries of storage batteries 18
28 back batteries of storage batteries 18
30 chest solar cells of solar cells 20
31 uppermost portions of chest-covering portion 24 of upper torso-covering garment 14
32 lengths of chest wire for allowing chest solar cells 30 of solar cells 20 to pass freely through openings 35 in chest-covering portion 15 of upper torso garment 12 and be replaceably attached thereto by hook and loop fasteners 33 for exposure to the sun
33 hook and loop fasteners
34 back solar cells of solar cells 20
35 openings in chest-covering portion 15 of upper torso garment 12
36 uppermost portions 36 of back-covering portion 22 of upper torso-covering garment 14
37 openings in back-covering portion 13 of upper torso garment 12
38 lengths of back wire for allowing back solar cells 34 of solar cells 20 to pass freely through openings 37 in back-covering portion 13 of upper torso garment 12 and be replaceably attached thereto by hook and loop fasteners 40 for exposure to the sun

40 hook and loop fasteners

41 lengths of thermostat wire 41 for allowing thermostat 21 to pass freely through opening 42 in chest-covering portion 15 of upper torso garment 12 and be replaceably attached thereto by hook and loop fasteners 44

42 opening in chest-covering portion 15 of upper torso garment 12

44 hook and loop fasteners

DETAILED DESCRIPTION OF THE PREFERRED EMBODIMENT

Figure 2:
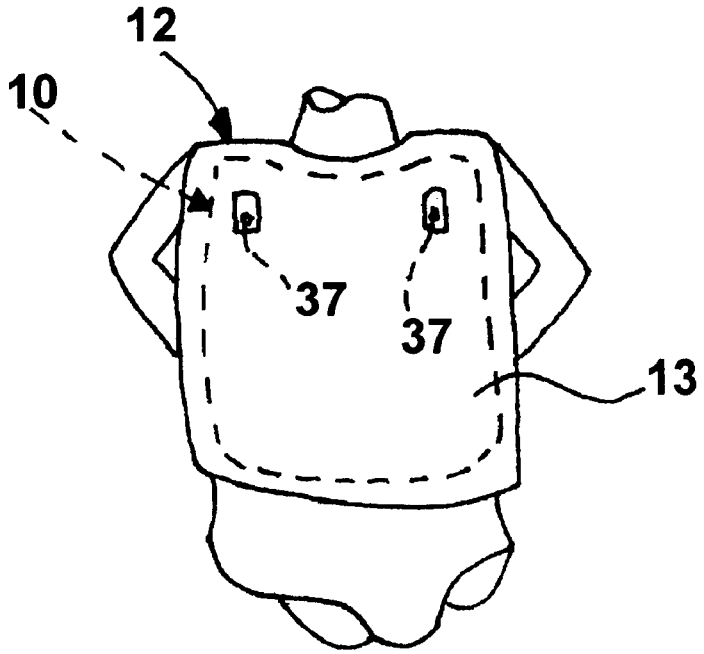
FIG. 2 is a diagrammatic rear elevational view of the present invention in use.

Referring now to the figures, in which like numerals indicate like parts, and particularly to FIGS. 1 and 2, which are, respectively, a diagrammatic front elevational view of the present invention in use, and a diagrammatic rear elevational view of the present invention in use, the heated liner of the present invention is shown generally at 10 for wearing under an upper torso garment 12, wherein the upper torso garment 12 includes a back-covering portion 13 and a chest-covering portion 15.

Figure 4:
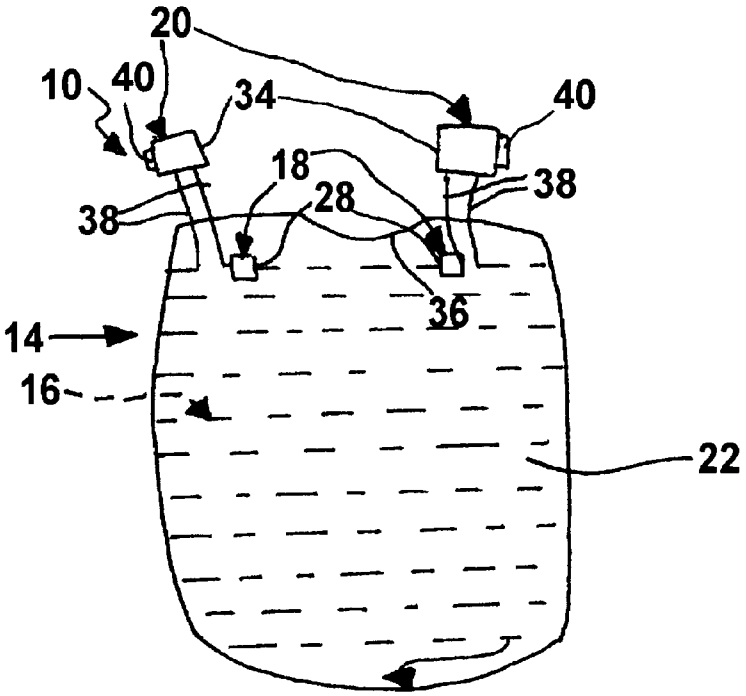
FIG. 4 is a diagrammatic rear elevational view of the present invention utilized in FIG. 2.
Figure 3:
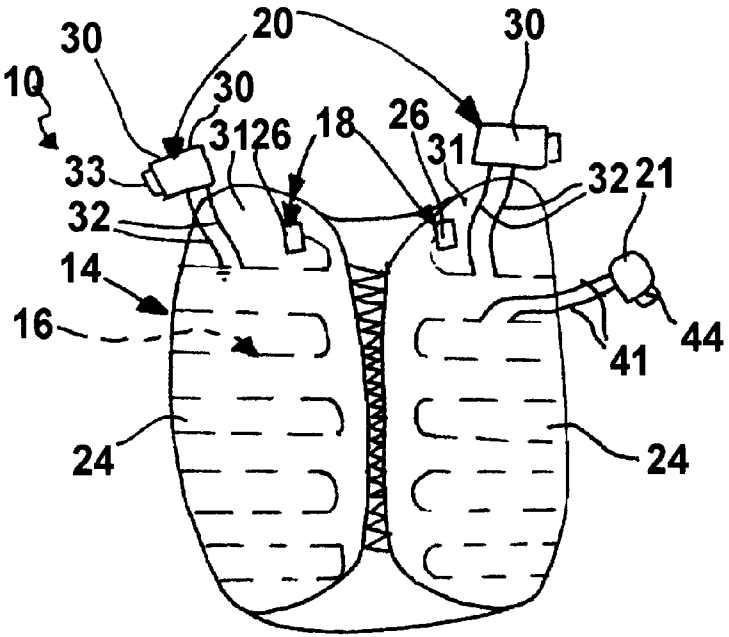
FIG. 3 is a diagrammatic front elevational view of the present invention utilized in FIG. 1.
Figure 5:
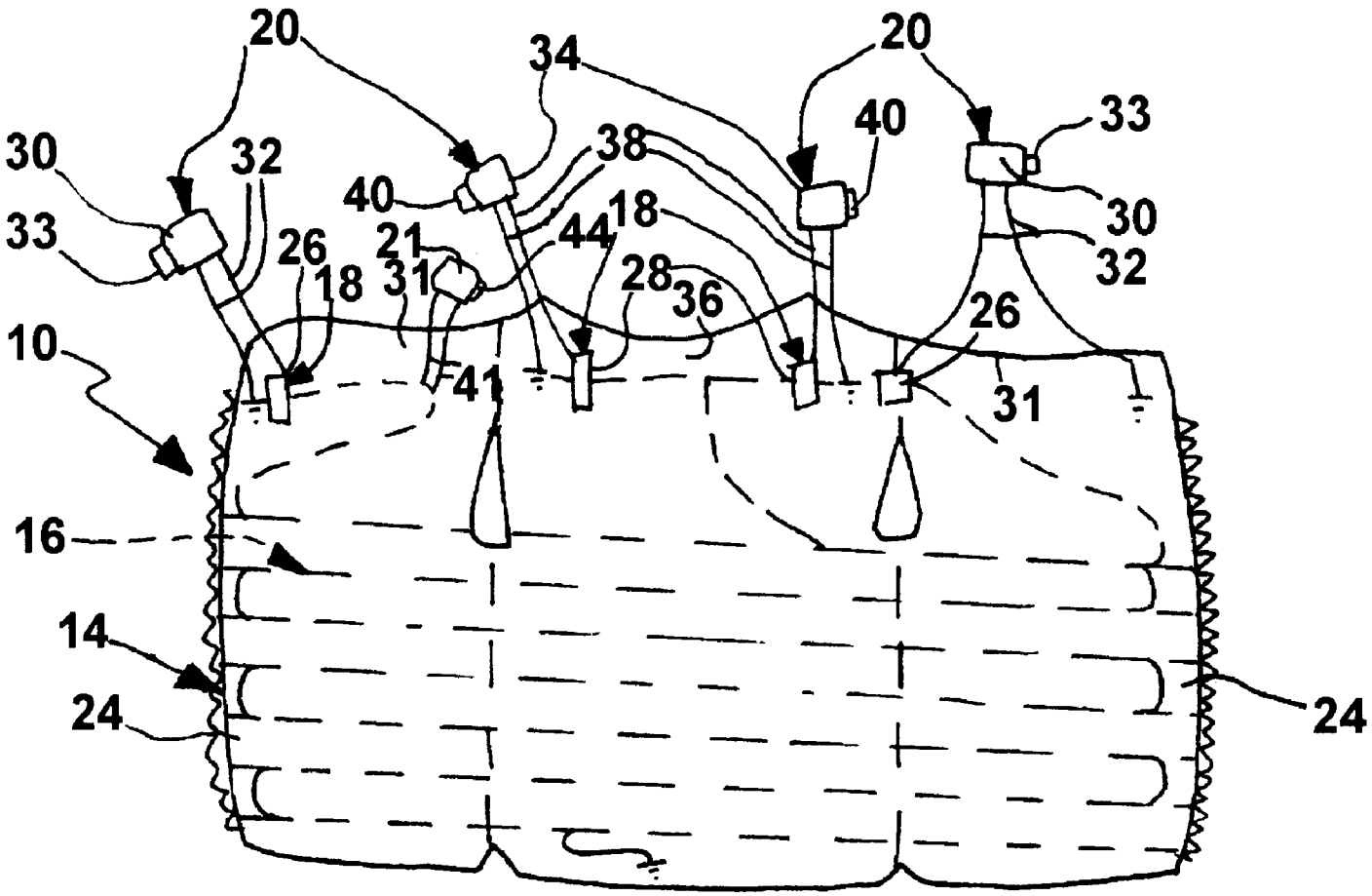
FIG. 5 is a diagrammatic rear elevational view of the present invention shown in FIGS. 3 and 4 in an unfolded position.

The configuration of the heated liner 10 can best be seen in FIGS. 3–5, which are, respectively, a diagrammatic front elevational view of the present invention utilized in FIG. 1, a diagrammatic rear elevational view of the present invention utilized in FIG. 2, and a diagrammatic rear elevational view of the present invention shown in FIGS. 3 and 4 in an unfolded position, and as such, will be discussed with reference thereto.

The heated liner 10 comprises an upper torso-covering garment 14 for underlying the upper torso garment 12.

The heated liner 10 further comprises heating wires 16 that are disposed in the upper torso-covering garment 14 for generating heat.

The heated liner 10 further comprises storage batteries 18 that are in electrical communication with, and power, the heating wires 16.

The heated liner 10 further comprises solar cells 20 that are in electrical communication with, and recharge, the storage batteries 18.

The heated liner 10 further comprises a thermostat 21 that is in electrical communication with, and for regulating the heat generated by, the heating wires 16.

The upper torso-covering garment 14 is flexible, conforming, and comprises a back-covering portion 22 for underlying the back-covering portion 13 of the upper torso garment 12, and a chest-covering portion 24 for underlying the chest-covering portion 15 of the upper torso garment 12.

The heating wires 16 form a continuous serpentine pattern throughout the chest-covering portion 24 of the upper torso-covering garment 14 and the back-covering portion 22 of the upper torso-covering garment 14.

The storage batteries 18 comprise chest batteries 26 that are disposed on opposite sides of the chest-covering portion 24 of the upper torso-covering garment 14 for balance.

The storage batteries 18 further comprise back batteries 28 that are disposed on opposite sides of the back-covering portion 22 of the upper torso-covering garment 14 for balance.

The solar cells 20 comprise chest solar cells 30 that extend from uppermost portions 31 of the chest-covering portion 24 of the upper torso-covering garment 14, by lengths of chest wire 32 for allowing the chest solar cells 30 to pass freely through openings 35 (see FIG. 1) in the chest-covering portion 15 of the upper torso garment 12 and be replaceably attached thereto by hook and loop fasteners 33 for exposure to the sun.

The solar cells 20 further comprise back solar cells 34 that extend from uppermost portions 36 of the back-covering portion 22 of the upper torso-covering garment 14, by lengths of back wire 38 for allowing the back solar cells 34 to pass freely through openings 37 (see FIG. 2) in the back-covering portion 13 of the upper torso garment 12 and be replaceably attached thereto by hook and loop fasteners 40 for exposure to the sun.

The thermostat 21 extends from the chest-covering portion 24 of the upper torso-covering garment 14, by lengths of thermostat wire 41 for allowing the thermostat 21 to pass freely through an opening 42 (see FIG. 1) in the chest-covering portion 15 of the upper torso garment 12 and be replaceably attached thereto by hook and loop fasteners 44.

It will be understood that each of the elements described above, or two or more together, may also find a useful application in other types of constructions differing from the types described above.

While the invention has been illustrated and described as embodied in a heated liner for wearing under an upper torso garment, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A heated liner for wearing under an upper torso garment, wherein the upper torso garment includes a back-covering portion and a chest-covering portion, said liner comprising:

a) an upper torso-covering garment for underlying the upper torso garment;

b) heating wires disposed in said upper torso-covering garment for generating heat;

c) storage batteries in electrical communication with, and powering, said heating wires;

d) solar cells in electrical communication with, and recharging, said storage batteries; and e) a thermostat in electrical communication with, and for regulating the heat generated by, said heating wires;

wherein said upper torso-covering garment is flexible, conforming, and comprises:

i) a back-covering portion for underlying the back-covering portion of the upper torso garment; and ii) a chest-covering portion for underlying the chest-covering portion of the upper torso garment; and wherein said storage batteries comprise chest batteries that are disposed on opposite sides of said chest-covering portion of said upper torso-covering garment for balance.

2. The liner as defined in claim 1, wherein said heating wires form a continuous serpentine pattern throughout said chest-covering portion of said upper torso-covering garment and said back-covering portion of said upper torso-covering garment.

3. The liner as defined in claim 1, wherein said storage batteries comprise back batteries that are disposed on opposite sides of said back-covering portion of said upper torso-covering garment for balance.

4. The liner as defined in claim 1, wherein said solar cells comprise chest solar cells that extend from uppermost portions of said chest-covering portion of said upper torso-covering garment, by lengths of chest wire for allowing said-chest solar cells to pass freely through openings in the chest-covering portion of the upper torso garment and be replaceably attached thereto by hook and loop fasteners for exposure to the sun.

5. The liner as defined in claim 1, wherein said solar cells comprise back solar cells that extend from uppermost portions of said back-covering portion of said upper torso-covering garment, by lengths of back wire for allowing said back solar cells to pass freely through openings in the back-covering portion of the upper torso garment and be replaceably attached thereto by hook and loop fasteners for exposure to the sun.

6. The liner as defined in claim 1, wherein said thermostat extends from said chest-covering portion of said upper torso-covering garment, by lengths of thermostat wire for allowing said thermostat to pass freely through an opening in the chest-covering portion of the upper torso garment and be replaceably attached thereto by hook and loop fasteners.

* * * * *